US011345379B2

(12) United States Patent
Koshino

(10) Patent No.: US 11,345,379 B2
(45) Date of Patent: May 31, 2022

(54) TRAIN LOCATION MEASUREMENT SYSTEM, ONBOARD DEVICE, GROUND DEVICE, AND TRAIN LOCATION MEASUREMENT METHOD

(71) Applicant: Mitsubishi Electric Corporation, Tokyo (JP)

(72) Inventor: Daisuke Koshino, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 383 days.

(21) Appl. No.: 16/611,287

(22) PCT Filed: May 15, 2017

(86) PCT No.: PCT/JP2017/018168
§ 371 (c)(1),
(2) Date: Nov. 6, 2019

(87) PCT Pub. No.: WO2018/211553
PCT Pub. Date: Nov. 22, 2018

(65) Prior Publication Data

US 2020/0164905 A1 May 28, 2020

(51) Int. Cl.
*B61L 25/02* (2006.01)
*B61L 15/00* (2006.01)
(Continued)

(52) U.S. Cl.
CPC ..... *B61L 25/02* (2013.01); *B61L 15/0018* (2013.01); *B61L 15/0072* (2013.01); *B61L 3/00* (2013.01);
(Continued)

(58) Field of Classification Search
CPC .... B61L 25/02; B61L 25/025; B61L 15/0018; B61L 15/0072; B61L 3/00; B61L 23/00
See application file for complete search history.

(56) References Cited

U.S. PATENT DOCUMENTS

2008/0231506 A1* 9/2008 Stull ..... G01S 19/11 342/357.33
2014/0209759 A1* 7/2014 Tsukamoto ..... B61L 3/008 246/2 S
2015/0008293 A1* 1/2015 Hatazaki ..... B61L 27/0038 246/30
(Continued)

FOREIGN PATENT DOCUMENTS

CN 102923167 B 10/2015
JP 2001128222 A 5/2001
(Continued)

OTHER PUBLICATIONS

Office Action dated May 10, 2021, for corresponding Indian Patent Application No. 201927041756, 4 pages.
(Continued)

*Primary Examiner* — Zachary L Kuhfuss
(74) *Attorney, Agent, or Firm* — Buchanan Ingersoll & Rooney PC

(57) ABSTRACT

A train location measurement system includes a ground device that generates a signal that contains location measuring data, a base stations that each transmit the signal to the train, an onboard station that measures a first received signal strength of a first signal received from a first base station located in a travel direction of the train, and generates, using the location measuring data, first error information indicating an error occurrence status upon reception of the first signal, an onboard station that measures a second received signal strength of a second signal received from a second base station located in a direction opposite the travel direction of the train, and generates, using the location measuring data, second error information indicating an error occurrence status upon reception of the second signal, and an onboard device that measures the location of the train.

8 Claims, 10 Drawing Sheets

(51) Int. Cl.
*B61L 3/00* (2006.01)
*B61L 23/00* (2006.01)

(52) U.S. Cl.
CPC ..... *B61L 23/00* (2013.01); *B61L 25/025* (2013.01); *B61L 25/026* (2013.01)

(56) References Cited

U.S. PATENT DOCUMENTS

| | | | | |
|---|---|---|---|---|
| 2017/0158213 | A1* | 6/2017 | Mathews | G01C 21/28 |
| 2018/0001917 | A1* | 1/2018 | Kaede | B61L 15/0027 |
| 2018/0037242 | A1* | 2/2018 | Haedicke | B61L 25/025 |
| 2019/0359236 | A1* | 11/2019 | Tokumaru | B60L 15/20 |

FOREIGN PATENT DOCUMENTS

| | | | |
|---|---|---|---|
| KR | 200234233 | Y1 | 10/2001 |
| KR | 101835432 | B1 * | 3/2018 |

OTHER PUBLICATIONS

International Search Report (PCT/ISA/210) dated Jul. 18, 2017, by the Japan Patent Office as the International Searching Authority for International Application No. PCT/JP2017/018168.
Written Opinion (PCT/ISA237) issued on Jul. 18, 2017, by the Japan Patent Office as the International Searching Authority for International Application Na, PCT/JP2017/018168.

* cited by examiner

TRAIN LOCATION MEASUREMENT SYSTEM, ONBOARD DEVICE, GROUND DEVICE, AND TRAIN LOCATION MEASUREMENT METHOD

FIELD

The present invention relates to a train location measurement system, an onboard device, a ground device, and a train location measurement method, each for measuring the location of a train.

BACKGROUND

Conventionally, technology exists for a mobile station to estimate the location of that station itself by wirelessly communicating with a plurality of base stations and by using received signal strengths of wireless signals that the mobile station receives from the plurality of base stations (Patent Literature 1). An example of the mobile station is an onboard station installed on a train. An example of the received signal strength is a received signal strength indicator (RSSI).

CITATION LIST

Patent Literature

Patent Literature 1: Japanese Patent Application Laid-open No. 2001-128222

SUMMARY

Technical Problem

However, the foregoing conventional technology presents a problem of degradation in measurement accuracy of the location of a mobile station in a highly interfering environment due to an effect of interference signals on the RSSI. A variation in the RSSI caused by the fading may also degrade the measurement accuracy of the location of a mobile station.

The present invention has been made in view of the foregoing, and it is an object of the present invention to provide a train location measurement system capable of providing improved measurement accuracy of a train location.

Solution to Problem

A train location measurement system according to an aspect of the present invention includes a ground device installed on a ground to generate a signal that contains data for location measurement (hereinafter, location measuring data) for use in a train in measurement of a location of that train, and to output the signal to a plurality of base stations, and the plurality of base stations each installed on the ground to transmit the signal obtained from the ground device to the train. The train location measurement system also includes a first onboard station installed on the train to measure a first received signal strength of a first signal, which is the signal received from a first base station located in a travel direction of the train, among the plurality of base stations, and to generate, using the location measuring data, first error information indicating an error occurrence status upon reception of the first signal, a second onboard station installed on the train to measure a second received signal strength of a second signal, which is the signal received from a second base station located in a direction opposite the travel direction of the train, among the plurality of base stations, and to generate, using the location measuring data, second error information indicating an error occurrence status upon reception of the second signal, and an onboard device installed on the train to measure the location of the train based on the first received signal strength, on the first error information, on the second received signal strength, and on the second error information.

Advantageous Effects of Invention

The present invention provides an advantage in that the train location measurement system can provide improved measurement accuracy of the train location.

DESCRIPTION OF EMBODIMENTS

A train location measurement system, an onboard device, a ground device, and a train location measurement method according to embodiments of the present invention will be described in detail below with reference to the drawings. Note that these embodiments are not intended to limit this invention.

First Embodiment

Figure 1:
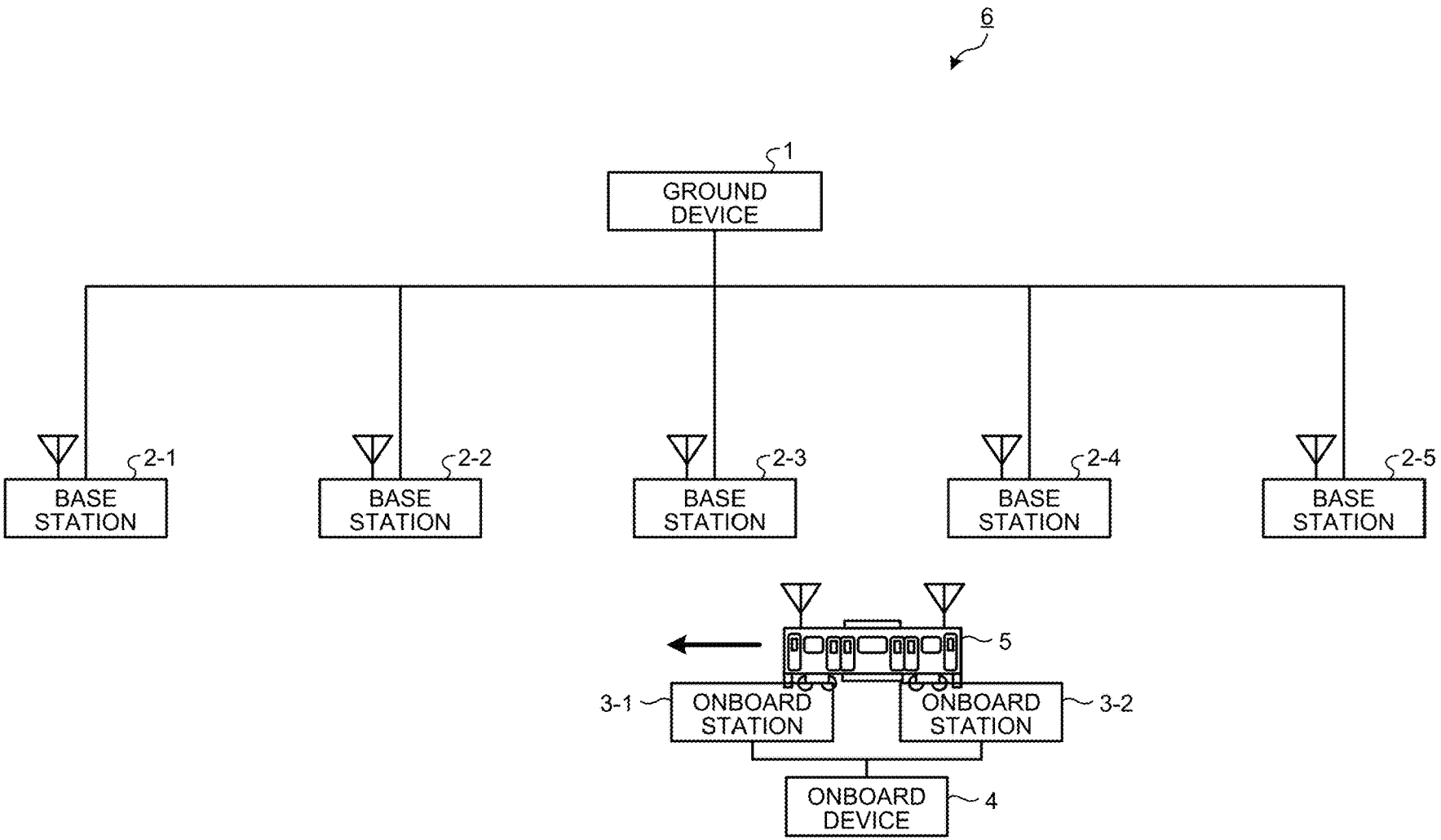
FIG. 1 is a diagram illustrating an example configuration of a train location measurement system according to a first embodiment.

FIG. 1 is a diagram illustrating an example configuration of a train location measurement system 6 according to a first embodiment of the present invention. The train location measurement system 6 includes a ground device 1 installed on the ground, and base stations 2-1 to 2-5 installed on the ground. The base stations 2-1 to 2-5 are installed along the track on which a train 5 runs. In the example of FIG. 1, the base stations 2-1 to 2-5 are illustrated as being connected to a single ground device 1, which is given merely by way of example, and may also be connected to multiple ground devices 1 not illustrated. FIG. 1 illustrates the five base stations 2-1 to 2-5, but the number of the base stations is not limited to five.

The train location measurement system 6 also includes onboard stations 3-1 and 3-2 installed on the train 5, and an onboard device 4 installed on the train 5. The onboard stations 3-1 and 3-2 are installed in the front and rear cabs of the train 5. The example of FIG. 1 illustrates the train 5 as consisting of a single vehicle for schematic illustration, but the train 5 may consist of multiple vehicles, in which case one of the onboard stations 3-1 and 3-2 is installed in the lead vehicle of the train 5, and the other thereof is installed in the last vehicle of the train 5. In the example of FIG. 1, the onboard stations 3-1 and 3-2 are illustrated as being connected to a single onboard device 4, but may also be connected to multiple onboard devices 4 not illustrated. The train location measurement system 6 is a wireless train control system that allows the ground device 1 and the onboard device 4 to communicate with each other via the base stations 2-1 to 2-5 and via the onboard stations 3-1 and 3-2. Note that FIG. 1 illustrates the onboard stations 3-1 and 3-2 and the onboard device 4 outside the train 5, but in fact, the onboard stations 3-1 and 3-2 and the onboard device 4 are disposed inside the train 5.

The train 5 is assumed to travel leftward as indicated by the arrow in FIG. 1. In the example of FIG. 1, the train 5 includes the onboard station 3-1 installed in the cab in the travel direction, and the onboard station 3-2 installed in the cab in the direction opposite the travel direction. The onboard station 3-1 is also referred to herein as first onboard station, and the onboard station 3-2 is also referred to herein as second onboard station. The onboard stations 3-1 and 3-2 are each connected to one base station 2 out of the base stations 2-1 to 2-5. Each of the onboard stations 3-1 and 3-2 can be connected to any base station 2 out of the base stations 2-1 to 2-5. Note that the onboard stations 3-1 and 3-2 have directivity in sending and receiving signals. Thus, when the train 5 is located in the location as illustrated in FIG. 1, the onboard station 3-1 exchanges signals with one base station 2 of the base stations 2-1 to 2-3 located in the travel direction of the train 5, while the onboard station 3-2 exchanges signals with one base station 2 of the base stations 2-4 and 2-5 located in the direction opposite the travel direction of the train 5. A signal received by the onboard station 3-1 is herein referred to as first signal, and a signal received by the onboard station 3-2 is herein referred to as second signal. In the description below, the base stations 2-1 to 2-5 may also be referred to as base station(s) 2 when no distinction is made, and the onboard stations 3-1 and 3-2 may also be referred to as onboard station(s) 3 when no distinction is made.

Figure 2:
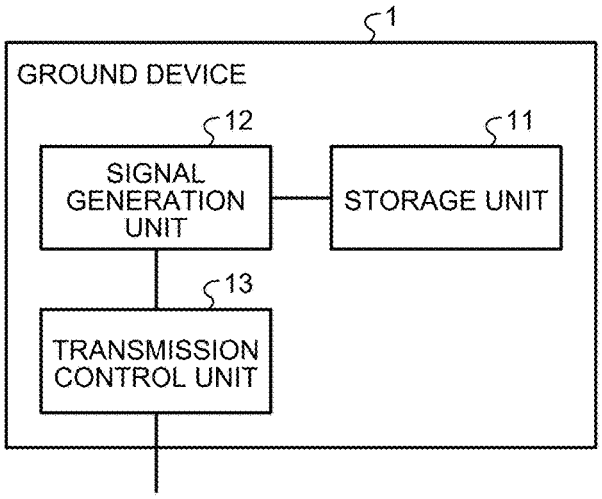
FIG. 2 is a block diagram illustrating an example configuration of a ground device according to the first embodiment.

A configuration of the ground device 1 will next be described. FIG. 2 is a block diagram illustrating an example configuration of the ground device 1 according to the first embodiment. The ground device 1 includes a storage unit 11, a signal generation unit 12, and a transmission control unit 13. The storage unit 11 stores data for location measurement (hereinafter, location measuring data), which is data for use in the train 5 in measurement of the location of that train 5. Note that the ground device 1 may include, instead of the storage unit 11, a data generation unit that generates location measuring data. The signal generation unit 12 stores, in the payload, the location measuring data stored in the storage unit 11 and a control signal for the train 5, and then generates a signal having a frame format including a header and a footer both affixed to the payload. To allow the signal generated by the signal generation unit 12 to be transmitted to the train 5 via the base stations 2-1 to 2-5, the transmission control unit 13 outputs this signal to the base stations 2-1 to 2-5. Note that FIG. 2 illustrates only the components needed for the present embodiment, and thus omits general components.

Figure 3:
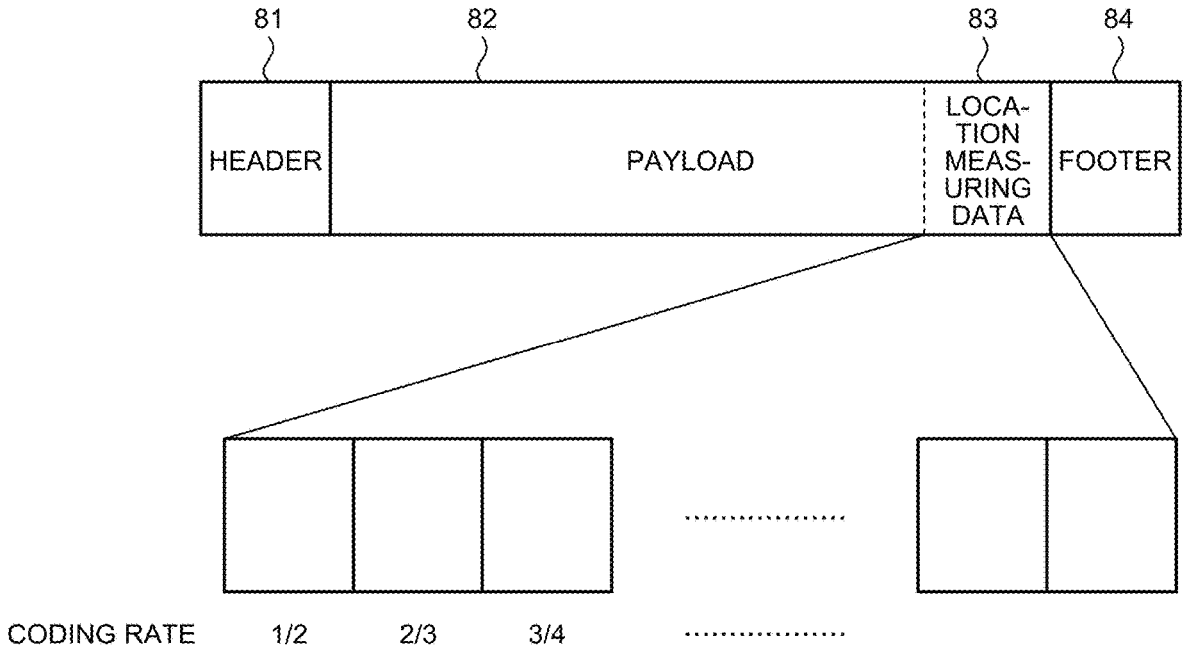
FIG. 3 is a diagram illustrating an example format of a signal, i.e., a frame, output from the ground device according to the first embodiment.

FIG. 3 is a diagram illustrating an example format of the signal, i.e., the frame, output from the ground device 1 according to the first embodiment. The signal output from the ground device 1 includes areas for a header 81, a payload 82, location measuring data 83, and a footer 84. The location measuring data 83 is, in fact, part of the payload 82. That is, the area for the location measuring data 83 is arranged within the area for the payload 82 of the signal output from the ground device 1. It is assumed here that the location measuring data 83 contains plural pieces of data encoded by different coding rates. It is assumed that the pieces of data of the coding rates are preset. Although FIG. 3 presents coding rates such as 1/2, 2/3, and 3/4 as an example of the plural coding rates, this is merely by way of example, and values of the coding rates are not particularly limited. A higher number of values of coding rate leads to higher measurement accuracy of the location of the train 5 obtained by the onboard device 4 described later. In addition, the data length of the location measuring data 83 has no limitation in FIG. 3. A greater amount of data, i.e., a greater data length, will result in higher measurement accuracy of the location of the train 5 obtained by the onboard device 4 described later.

Although the example of FIG. 3 illustrates the area for the location measuring data 83 of a single signal as containing pieces of data of a plurality of coding rates (hereinafter also referred to simply as "data of plural coding rates"), the frame structure is not limited thereto. For example, the ground device 1 stores data of only one coding rate in the area for the location measuring data 83 of a single signal. The ground device 1 may change the data of the coding rate on a per signal basis, and distribute the pieces of data of different coding rates in plural signals and separately transmit the pieces of data using the plural signals.

To enable the train 5 to identify the base station 2 from which a signal is received, the base stations 2-1 to 2-5 each add an identifier of that base station to the header 81 or to the payload 82 of the signal obtained from the ground device 1, and send this signal to the train 5. Due to a standard configuration similar to the configuration of a conventional technology, detailed description of the configuration of the base stations 2-1 to 2-5 will be omitted.

Figure 4:
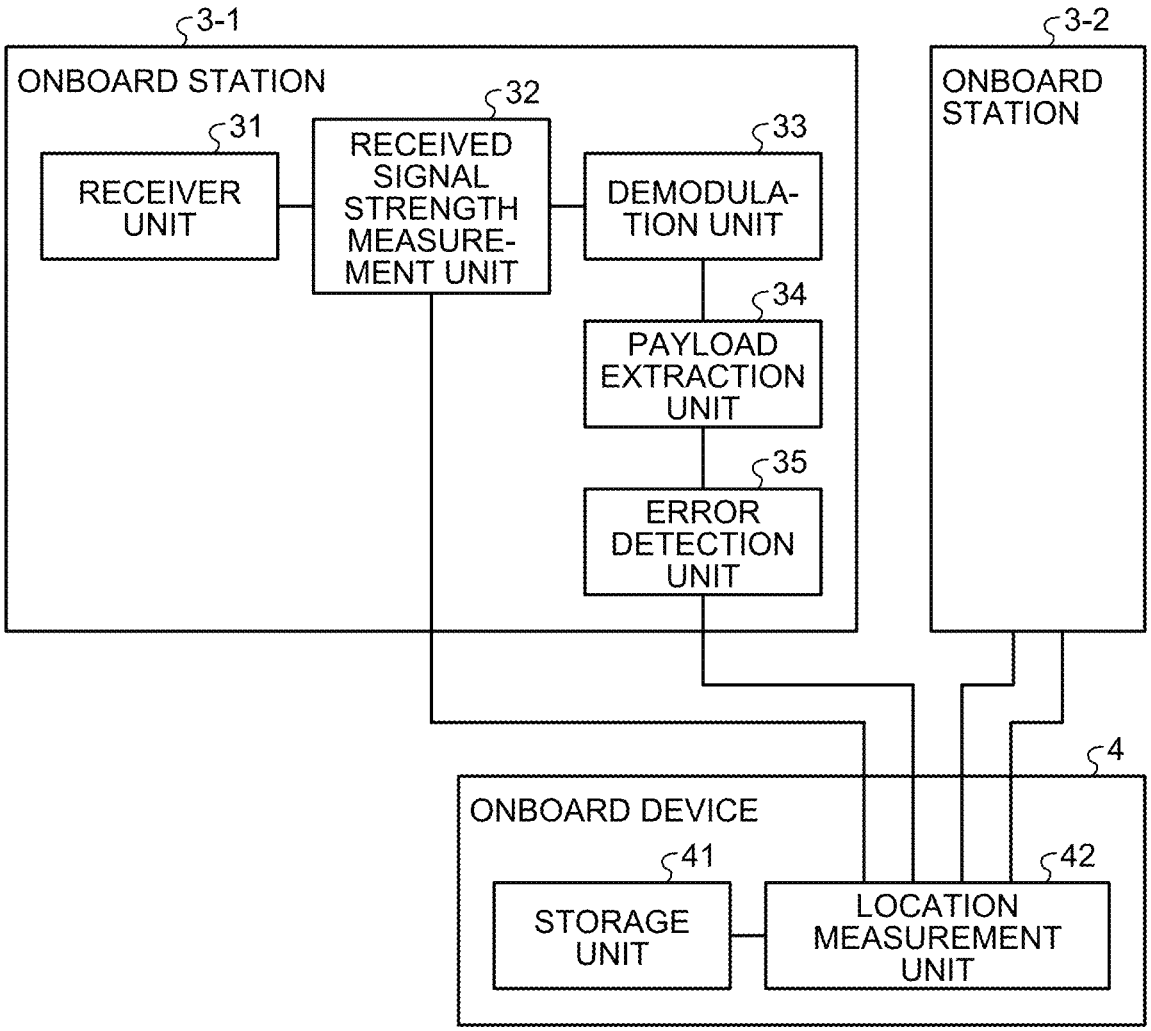
FIG. 4 is a block diagram illustrating an example configuration of an onboard station and an onboard device installed on a train according to the first embodiment.

A configuration of the onboard station 3 will next be described. FIG. 4 is a block diagram illustrating an example configuration of the onboard stations 3 and the onboard device 4 installed on the train 5 according to the first embodiment. Due to the similarity in configuration of the onboard stations 3-1 and 3-2, the onboard station 3-1 will be used to describe the configuration of the onboard stations 3, and the onboard station 3-2 is thus illustrated in outline. The onboard station 3-1 includes a receiver unit 31, a received signal strength measurement unit 32, a demodulation unit 33, a payload extraction unit 34, and an error detection unit 35.

The receiver unit 31 performs general reception processing on a received signal, such as conversion processing from a radio frequency to a baseband frequency of the signal received from the base station 2, and analog-to-digital (AD) conversion of the signal after the conversion to a baseband frequency. The received signal strength measurement unit 32 measures the received signal strength, specifically, the RSSI, of the signal after the AD conversion. As used herein, the RSSI measured by the received signal strength measurement unit 32 of the onboard station 3-1 is referred to as first received signal strength, and the RSSI measured by the received signal strength measurement unit 32 of the onboard station 3-2 is referred to as second received signal strength. Although FIG. 4 illustrates the receiver unit 31 and the received signal strength measurement unit 32 as separate components, the receiver unit 31 may measure the RSSI during the above process performed on the received signal. The demodulation unit 33 demodulates the signal after the RSSI measurement.

The payload extraction unit 34 removes the header 81 and the footer 84 from the demodulated signal, and thus extracts the payload 82 containing the location measuring data 83. Alternatively, the payload extraction unit 34 may extract only the portion of the location measuring data 83 in the payload 82 as illustrated in FIG. 3. The error detection unit 35 detects an error upon reception of a signal from the base station 2 by using the location measuring data 83 contained in the payload 82 extracted by the payload extraction unit 34, or the location measuring data 83 extracted by the payload extraction unit 34. In the example of FIG. 3, the error detection unit 35 detects a bit error in each of the pieces of data of the plural coding rates contained in the location measuring data 83. The error detection unit 35 generates error information indicating an error occurrence status upon reception of the signal from the base station 2. The phrase "error information indicating an error occurrence status" specifically means a bit error rate for each coding rate. The onboard station 3-1 outputs the RSSI measured by the received signal strength measurement unit 32 and the error information generated by the error detection unit 35 to the onboard device 4.

The onboard station 3-2 has a configuration similar to the configuration of the onboard station 3-1. The onboard station 3-2 also outputs an RSSI measured by the received signal strength measurement unit 32, and error information generated by the error detection unit 35 to the onboard device 4. As used herein, the error information generated by the error detection unit 35 of the onboard station 3-1 is referred to as first error information, and the error information generated by the error detection unit 35 of the onboard station 3-2 is referred to as second error information. Note that FIG. 4 illustrates only the components needed for the present embodiment, and thus omits general components.

A configuration of the onboard device 4 will next be described. As illustrated in FIG. 4, the onboard device 4 includes a storage unit 41 and a location measurement unit 42.

The storage unit 41 stores base station location information indicating the location of each base station 2 of the base stations 2-1 to 2-5, train length information indicating the length of the train 5, a received signal strength characteristic representing the relationship between the distance from each base station 2 of the base stations 2-1 to 2-5 and the RSSI, and an error characteristic representing the relationship between the distance from each base station 2 of the base stations 2-1 to 2-5 and the error occurrence status indicated by error information.

The location measurement unit 42 obtains, from the onboard station 3-1, the RSSIs measured for the respective signals received from the base stations 2 which are located in the travel direction of the train 5, among the base stations 2-1 to 2-5; and the error information indicating the occurrence status of error detected using the location measuring data 83. The location measurement unit 42 further obtains, from the onboard station 3-2, the RSSIs measured for the respective signals received from the base stations 2 which are located in the direction opposite the travel direction of the train 5, among the base stations 2-1 to 2-5; and the error information indicating the occurrence status of error detected using the location measuring data 83. The location measurement unit 42 measures the location of the train 5 based on the RSSIs and the error information obtained from the onboard station 3-1, and on the RSSIs and the error information obtained from the onboard station 3-2, using information stored in the storage unit 41. The phrase "information stored in the storage unit 41" refers to, as described above, the base station location information, the train length information, the received signal strength characteristic, and the error characteristic. Note that FIG. 4 illustrates only the components needed for the present embodiment, and thus omits general components.

Specifically, the location measurement unit 42 compares the error information obtained from the onboard stations 3-1 and 3-2 with the error characteristic, and uses the base station location information and the train length information, thus to determine at which location between which base stations 2 the train 5 is present. The location measurement unit 42 then compares the RSSIs obtained from the onboard stations 3-1 and 3-2 with the received signal strength characteristic, and uses the base station location information and the train length information, thus to correct the location of the train 5. Note that the location measurement unit 42 may instead determine at which location between which base stations 2 the train 5 is present using the RSSIs, the received signal strength characteristic, the base station location information, and the train length information, and then correct the location of the train 5 using the error information, the error characteristic, the base station location information, and the train length information. The onboard stations 3-1 and 3-2 have directivity, and thus receive signals from different groups of the base stations 2. This enables the location measurement unit 42 to determine between which base stations 2 the train 5 is present by computing the distance from the train 5, more specifically, from each of the onboard stations 3, to the base station 2 that has transmitted the signal. The location measurement unit 42 monitors the RSSIs to prevent overreach situations and/or the like.

Figure 5:
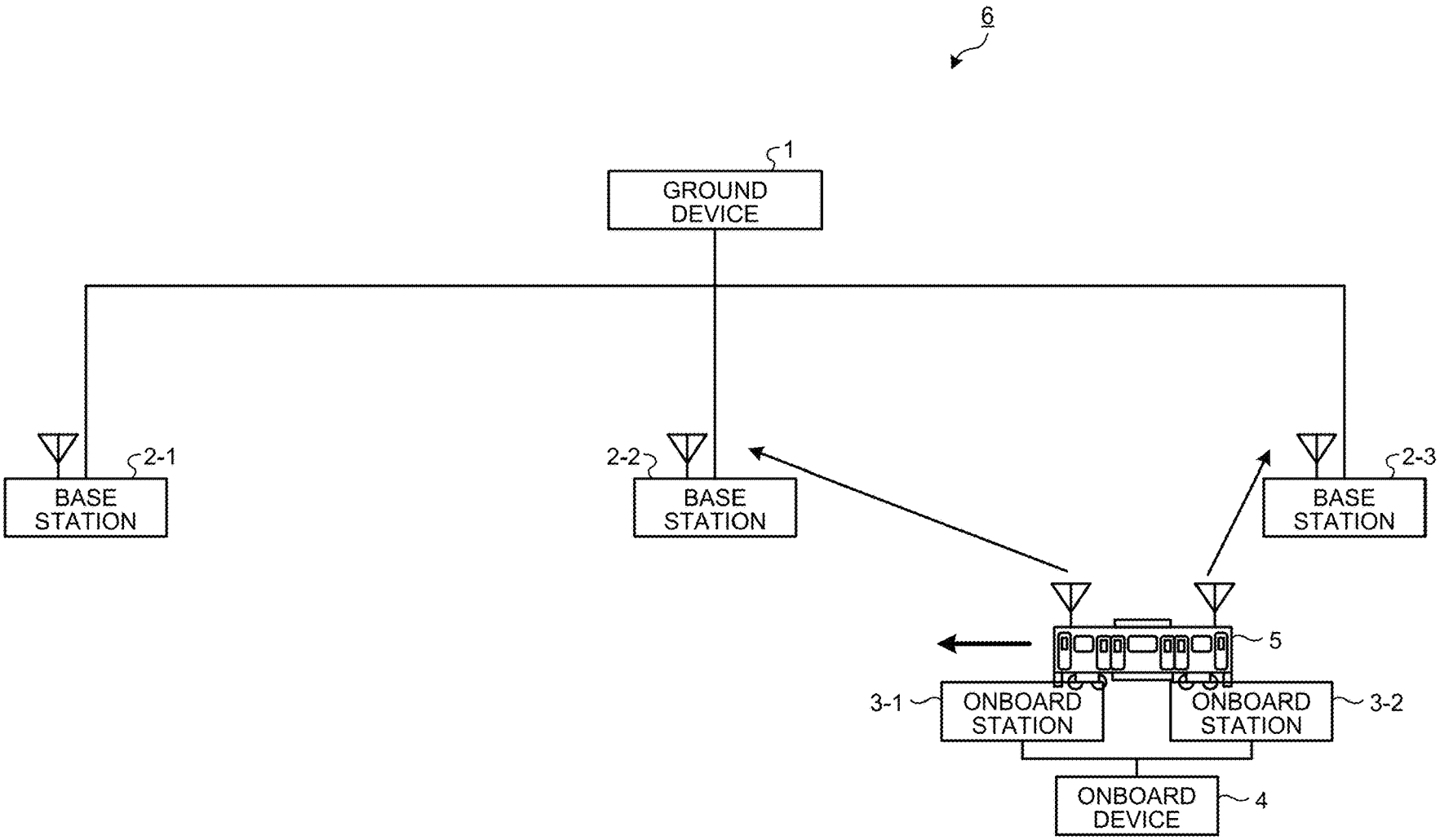
FIG. 5 is a diagram illustrating an example of train location measurement process performed in the onboard device according to the first embodiment.

A process of the location measurement of the train 5 performed by the location measurement unit 42 will now be described using a concrete example. FIG. 5 is a diagram illustrating an example of process of location measurement of the train 5 performed in the onboard device 4 according to the first embodiment. In the example of FIG. 5, it is seen that the distance between the onboard station 3-2 and the base station 2-3 is less than the distance between the onboard station 3-1 and the base station 2-2. In this case, the use of a coding rate associated with low demodulation performance such as 3/4 will result in a relationship of the bit error rate of the onboard station 3-1> (greater than) the bit error rate of the onboard station 3-2, that is, will result in higher reception quality and a lower bit error rate on the onboard station 3-2. The location measurement unit 42 of the onboard device 4 can determine the relative location of the train 5 based on the bit error rates of the onboard stations 3-1 and 3-2. The location measurement unit 42 may use a bit error rate for a coding rate other than 3/4 in comparison. Note that an even lower coding rate may cause too many bit errors to enable the location measurement unit 42 to make a comparison. Accordingly, the location measurement unit 42 makes a comparison among bit error rates at the plural coding rates to determine the relative location of the train 5 based on statistics of the bit error rates for the respective coding rates. This can provide improved measurement accuracy of the location of the train 5.

Figure 6:
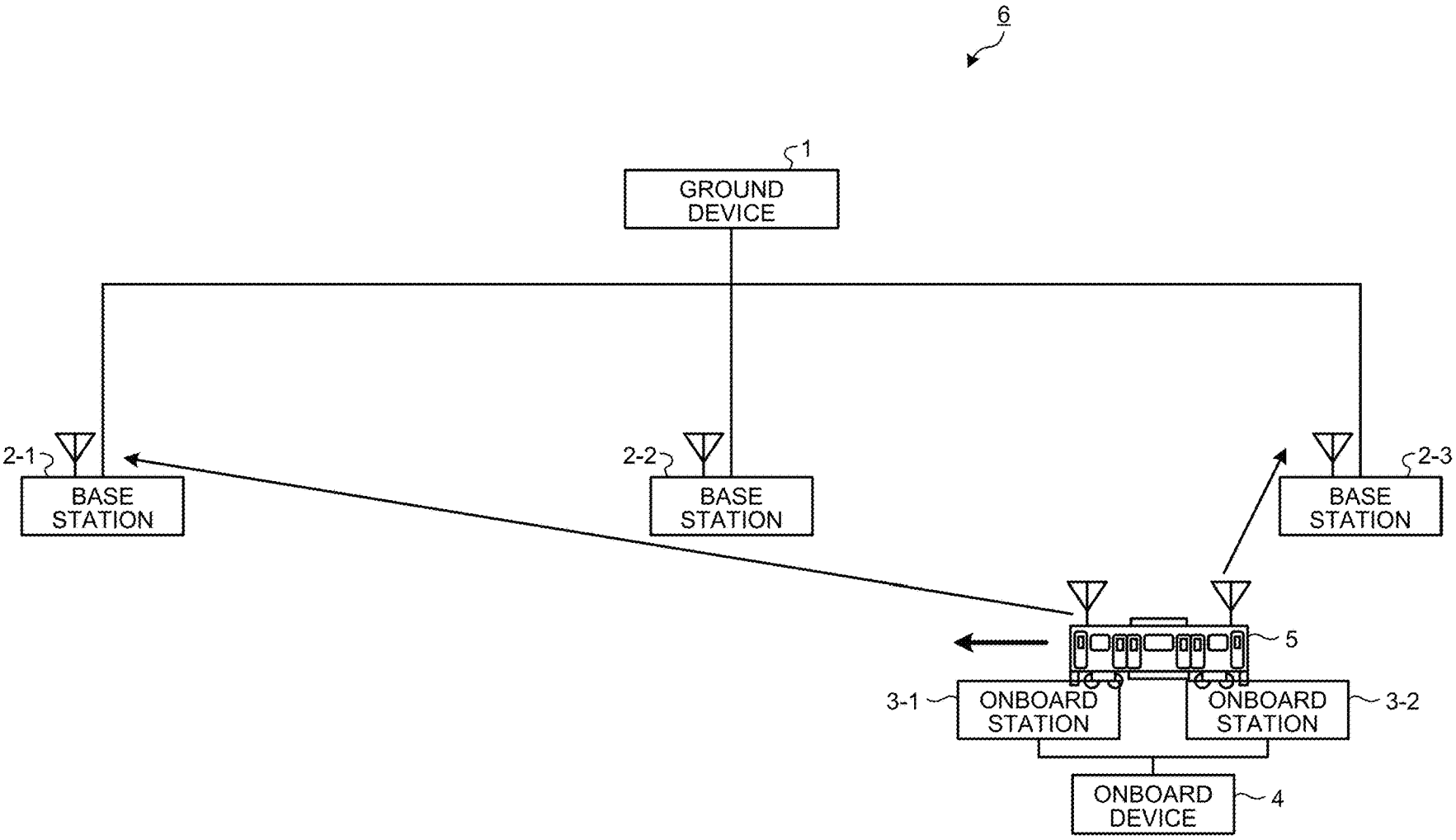
FIG. 6 is a diagram illustrating another example of train location measurement process performed in the onboard device according to the first embodiment.

FIG. 6 is a diagram illustrating another example of process of the location measurement of the train 5 performed in the onboard device 4 according to the first embodiment. The example of FIG. 6 assumes that the onboard station 3-1 is receiving a signal from the base station 2-1. In this case, on the onboard station 3-1, the distance between that station and the base station 2-1 is greater than the distance between the onboard station 3-2 and the base station 2-3, and is also greater than the distance between that station and the base station 2-2 in the example of FIG. 5. Therefore, many bit errors are likely to occur even at a coding rate of 1/2. In contrast, on the onboard station 3-2, the distance between that station and the base station 2-3 is less than the distance between the onboard station 3-1 and the base station 2-1. Therefore, only a few bit errors are likely to occur even at a coding rate of 3/4. Thus, by comparing bit error rates at plural coding rates, the location measurement unit 42 can provide improved measurement accuracy of the location of the train 5.

Figure 7:
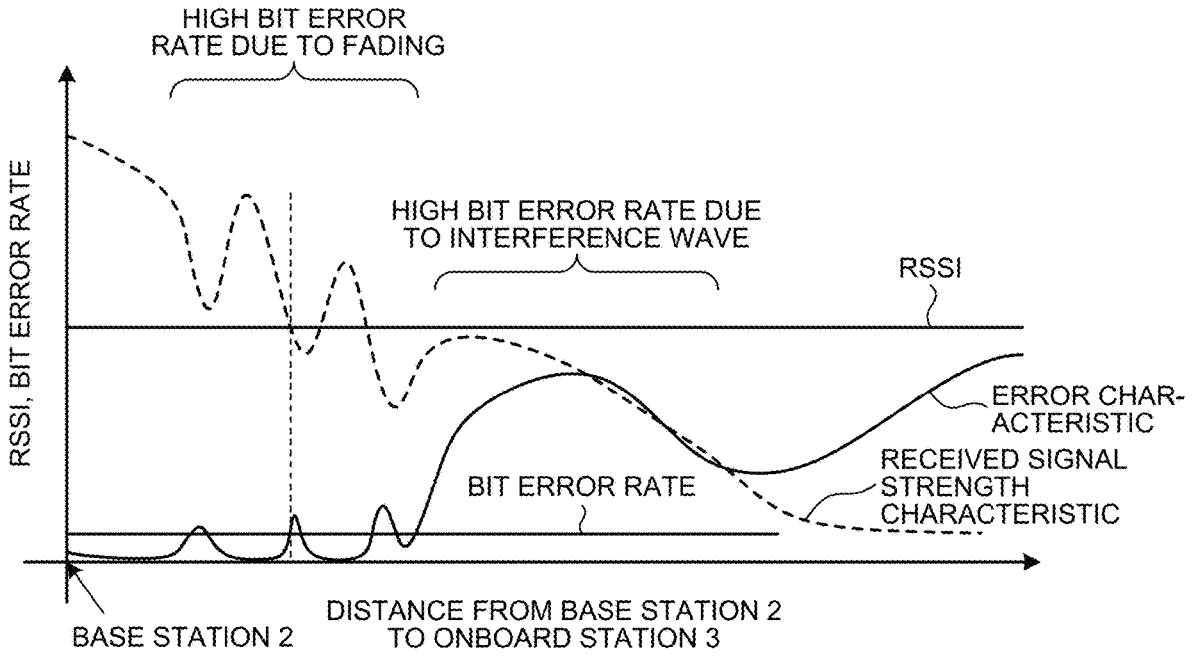
FIG. 7 is a diagram illustrating an example of information used in train location measurement performed by the location measurement unit according to the first embodiment.

In addition, the location measurement unit 42 can also determine whether there is an effect of fading or an effect of interference wave using the RSSIs obtained from the onboard stations 3-1 and 3-2. FIG. 7 is a diagram illustrating an example of information used in the location measurement of the train 5 performed by the location measurement unit 42 according to the first embodiment. In FIG. 7, the curves of the error characteristic and of the received signal strength characteristic represent data stored in the storage unit 41 of the onboard device 4. The curve of the error characteristic is for a certain coding rate, and may vary depending on which coding rate is used. In FIG. 7, the straight line of RSSI represents the measured RSSI value obtained from one onboard station 3 of the onboard stations 3-1 and 3-2. In FIG. 7, the straight line of bit error rate represents the error occurrence status indicated by error information, i.e., the bit error rate, obtained from one onboard station 3 of the onboard stations 3-1 and 3-2. Note that the values represented by the straight lines of RSSI and of bit error rate illustrated in FIG. 7 are actually values at a certain location from the base station 2 to the train 5. FIG. 7 illustrates the graph as such because the location of the train 5 is unknown, that is, the locations of the onboard stations 3-1 and 3-2 are unknown, at a time point when the location measurement unit 42 obtains the RSSIs and the bit error rates from the onboard stations 3-1 and 3-2.

As seen in the error characteristic and in the received signal strength characteristic illustrated in FIG. 7, when a high actually-measured bit error rate is observed despite a high actually-measured RSSI, the location measurement unit 42 can determine that this is caused by an effect of interference wave. Alternatively, as seen in the error characteristic and in the received signal strength characteristic illustrated in FIG. 7, when a low actually-measured RSSI has resulted in a high actually-measured bit error rate, the location measurement unit 42 can determine that this is caused by an effect of fading.

As illustrated in FIG. 7, the location measurement unit 42 can obtain the location of the train 5 relative to one of the base stations 2 based on an intersection between the straight line of bit error rate and the curve of error characteristic using the bit error rate measured in relation to a certain coding rate and using the error characteristic corresponding to that coding rate. In this regard, as illustrated in FIG. 7, the straight line of bit error rate and the curve of error characteristic may intersect at plural points. In such case, as illustrated in FIG. 7, the location measurement unit 42 can obtain the location of the train 5 relative to one of the base stations 2 based on an intersection between the straight line of RSSI and the curve of received signal strength characteristic using the RSSI and the received signal strength characteristic. In this regard, as illustrated in FIG. 7, the straight line of RSSI and the curve of received signal strength characteristic may also intersect at plural points. Even in such case, if one of the intersections between the straight line of bit error rate and the curve of error characteristic and one of the intersections between the straight line of RSSI and the curve of received signal strength characteristic occur at a same location, i.e., at a same distance, the location measurement unit 42 can determine that the point of that distance is the location of the train 5. FIG. 7 illustrates, by the dotted line, the location of the train 5, more specifically, the distance from one of the base stations 2 to one of the onboard stations 3 installed on the train 5.

In the example of FIG. 7, one of the intersections between the straight line of bit error rate and the curve of error characteristic and one of the intersections between the straight line of RSSI and the curve of received signal strength characteristic occur at one same location, but more than one pair of the intersections may each occur at a same location. In this case, the location measurement unit 42 uses bit error rates and error characteristics for different coding rates, that is, bit error rates and error characteristics for plural coding rates. Thus, use of intersections between the straight line of RSSI and the curve of received signal strength characteristic, and sets of intersections between the straight line of bit error rate and the curve of error characteristic for plural coding rates enables the location measurement unit 42 to limit the location of the train 5, and thus to provide improved measurement accuracy of the location of the train 5. That is, it can also be said that the location measurement unit 42 extracts a candidate for the location of the train 5 for each of the coding rates based on the first error information and on the second error information for pieces of data of the different coding rates, and on the error characteristics of the respective coding rates; extracts a candidate for the location of the train 5 based on the first received signal strength, on the second received signal strength, and on the received signal strength characteristic; and then measures the location of the train 5 based on these extracted plural candidates for the location of the trains 5.

Note that, in a case in which none of the intersections between the straight line of bit error rate and the curve of error characteristic and none of the intersections between the straight line of RSSI and the curve of received signal strength characteristic occur at a same location, i.e., at a same distance, the location measurement unit 42 may use intersections apart from each other by a distance less than or equal to a preset threshold as intersections occurring at a same distance.

It is assumed that the onboard device 4 stores the error characteristic illustrated in FIG. 7 for each of the different coding rates, in the storage unit 41. That is, the storage unit 41 stores an error characteristic including a relationship, for each coding rate, between the distance from each of the base stations 2 and the bit error rate. The error characteristic for each coding rate may be provided by the administrator of the wireless train control system based on actual measurement during a run of the train 5 in advance, or based on a simulation or the like. It is also assumed that the onboard device 4 also stores the received signal strength characteristic in the storage unit 41. The received signal strength characteristic may also be provided by the administrator of the wireless train control system based on actual measurement during a run of the train 5 in advance, or based on a simulation or the like. The received signal strength characteristic may be provided in common for the base stations 2-1 to 2-5, or individually for each of the base stations 2-1 to 2-5.

Figure 8:
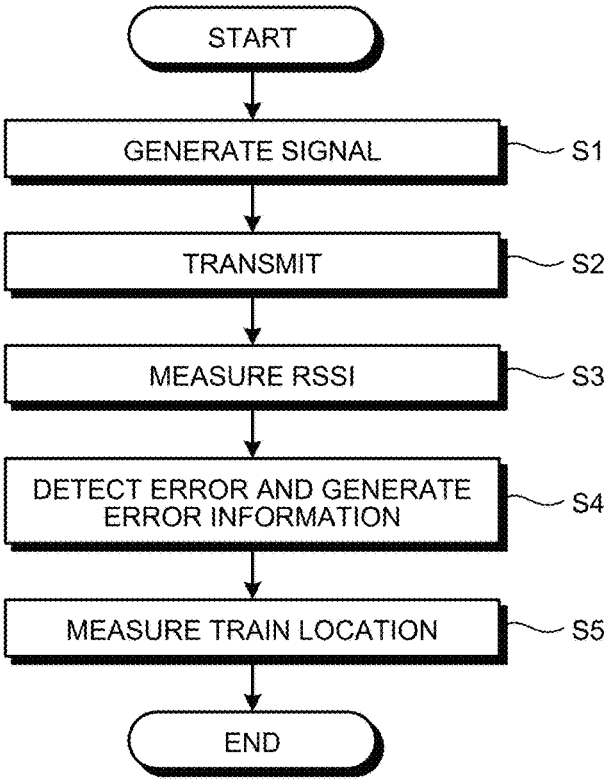
FIG. 8 is a flowchart illustrating an operation up to measurement of the location of the train by the onboard device in the train location measurement system according to the first embodiment.

An operation of measurement of the location of the train 5 performed by the onboard device 4 in the train location measurement system 6 will next be described with reference to a flowchart. FIG. 8 is a flowchart illustrating an operation up to measurement of the location of the train 5 by the onboard device 4 in the train location measurement system 6 according to the first embodiment. At first, the ground device 1 generates a signal containing the location measuring data 83 (step S1). The ground device 1 outputs the signal generated, to the base stations 2-1 to 2-5. The base stations 2-1 to 2-5 each transmit the signal obtained from the ground device 1 to the train 5 (step 62).

On the train 5, the onboard stations 3-1 and 3-2 measure the RSSIs of the signals received from different base stations 2 (step S3). The onboard stations 3-1 and 3-2 also each detect an error using the location measuring data 83 contained in the signal received, and each generate error information indicating an error occurrence status upon reception of the signal, i.e., the bit error rate for each coding rate (step S4). The onboard device 4 measures the location of the train 5 based on the RSSI and the error information obtained from the onboard station 3-1 and on the RSSI and the error information obtained from the onboard station 3-2, using information stored in the storage unit 41 (step S5).

Note that the present embodiment has been described in which the onboard device 4 uses the bit error rate for each coding rate contained in the location measuring data 83 as the error information to measure the location of the train 5, but the error information is not limited to a bit error rate. The error information may be information indicating whether an error has occurred or not. Thus, the data stored in the location measuring data 83 may be data for use in determination by means of error detection such as cyclic redundancy check (CRC), and the error information may thus be an error detection result.

In addition, although the present embodiment has been described in which the data stored in the location measuring data 83 is pieces of data of plural different coding rates, the data is not limited thereto. The data stored in the location measuring data 83 may be plural sets of data obtained from communication schemes having different levels of communication performance, i.e., different levels of demodulation performance, such as, for example, plural sets of data resulting from different modulation indices in amplitude modulation (AM), plural sets of data resulting from different numbers of modulation levels in multilevel modulation, or plural sets of data resulting from different degrees of correlation in code modulation. In this case, the onboard device 4 measures the location of the train 5, similarly to the present embodiment, using the error occurrence statuses, i.e., the error information, of the plural sets of data obtained.

A hardware configuration of the onboard device 4 will next be described. In the onboard device 4, the storage unit 41 is a memory; and the location measurement unit 42 is implemented in processing circuitry. That is, the onboard device 4 includes processing circuitry for measuring the location of the train 5. The processing circuitry may be a processor that executes a program stored in a memory and the memory, or may be a dedicated hardware element.

Figure 9:
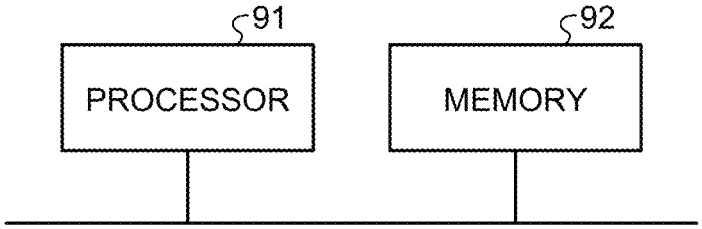
FIG. 9 is a diagram illustrating an example of a case in which the processing circuitry of the onboard device according to the first embodiment includes a processor and a memory.

FIG. 9 is a diagram illustrating an example of a case in which the processing circuitry of the onboard device 4 according to the first embodiment includes a processor and a memory. In a case in which the processing circuitry includes a processor 91 and a memory 92, the functionality of the processing circuitry of the onboard device 4 is implemented in software, firmware, or a combination of software and firmware. The software or firmware is described as a program, and is stored in the memory 92. In the processing circuitry, the processor 91 reads and executes a program stored in the memory 92, thus to implement the functionality. That is, in the onboard device 4, the processing circuitry includes the memory 92 for storing programs that cause the processor 91 to measure the location of the train 5. It can also be said that these programs cause a computer to perform the procedure and method of the onboard device 4.

In this regard, the processor 91 is, for example, a central processing unit (CPU), a processing unit, a computing unit, a microprocessor, a microcomputer, a digital signal processor (DSP), or the like. The memory 92 is, for example, a non-volatile or volatile semiconductor memory such as a random access memory (RAM), a read-only memory (ROM), a flash memory, an erasable programmable ROM (EPROM), or an electrically erasable programmable ROM (EEPROM) (registered trademark); a magnetic disk, a flexible disk, an optical disk, a compact disc, a MiniDisc, a digital versatile disc (DVD), or the like. The memory that serves as the storage unit 41 may be the memory 92.

Figure 10:
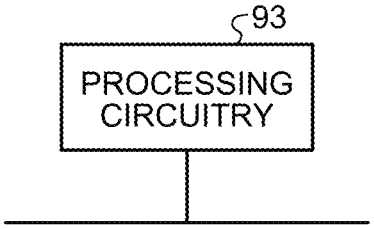
FIG. 10 is a diagram illustrating an example of a case in which the processing circuitry of the onboard device according to the first embodiment includes a dedicated hardware element.

FIG. 10 is a diagram illustrating an example of a case in which the processing circuitry of the onboard device 4 according to the first embodiment includes a dedicated hardware element. In a case in which the processing circuitry includes a dedicated hardware element, the processing circuitry 93 illustrated in FIG. 10 is, for example, a single circuit, a set of plural circuits, a programmed processor, a set of programmed processors, an application specific integrated circuit (ASIC), a field programmable gate array (FPGA), or a combination thereof. The functionality of the onboard device 4 may be implemented in the processing circuitry 93 on a function-by-function basis, or be implemented in the processing circuitry 93 collectively as a whole.

Note that the functionality of the processing circuitry of the onboard device 4 may be implemented partly in a dedicated hardware element, and partly in software or firmware. Thus, the processing circuitry can implement the foregoing functionality in a dedicated hardware element, software, firmware, or a combination thereof.

The hardware configuration of the onboard device 4 has been described. The onboard station 3 has a hardware configuration similar thereto. In the onboard station 3, the receiver unit 31 is a wireless receiver; and the received signal strength measurement unit 32, the demodulation unit 33, the payload extraction unit 34, and the error detection unit 35 are implemented in processing circuitry. Similarly to the onboard device 4, the processing circuitry of the onboard station 3 may be a processor that executes a program stored in a memory and the memory, or may be a dedicated hardware element. The ground device 1 also has a hardware configuration similar to the hardware configuration of the onboard device 4. In the ground device 1, the storage unit 11 is a memory; the transmission control unit 13 is an interface circuit; and the signal generation unit 12 is implemented in processing circuitry. Similarly to the processing circuitry of the onboard device 4, the ground device 1 may be a processor that executes a program stored in memory and the memory, or may be a dedicated hardware element.

As described above, according to the present embodiment, the train 5 includes the onboard stations 3-1 and 3-2 that each measure the RSSI of a signal received from one base station 2 of the base stations 2-1 to 2-5, and measure the bit error rate using the location measuring data 83, i.e., plural pieces of data encoded by different coding rates, contained in the signal received. The onboard device 4 then measures the location of the train 5 based on the RSSI and the error information obtained from each of the onboard stations 3-1 and 3-2. This enables the onboard device 4 to measure the location of the train 5 relative to the base stations 2 with high accuracy even on occurrence of fading, interference, or the like by using RSSIs and error information. In addition, the onboard device 4 uses the RSSI and the error information obtained from the onboard station 3-1 installed in the lead vehicle of the train 5 and the RSSI and the error information obtained from the onboard station 3-2 installed in the last vehicle of the train 5, that is, uses the RSSIs and pieces of the error information measured at two locations of the train 5, and can thus measure the location of the train 5 relative to the base stations 2 with high accuracy.

Second Embodiment

The first embodiment has been described in which the onboard station 3 of the train 5 detects an error in the signal received. In a second embodiment, a case will be described in which an error is detected by an onboard device 4*a* of a train 5*a*.

Figure 11:
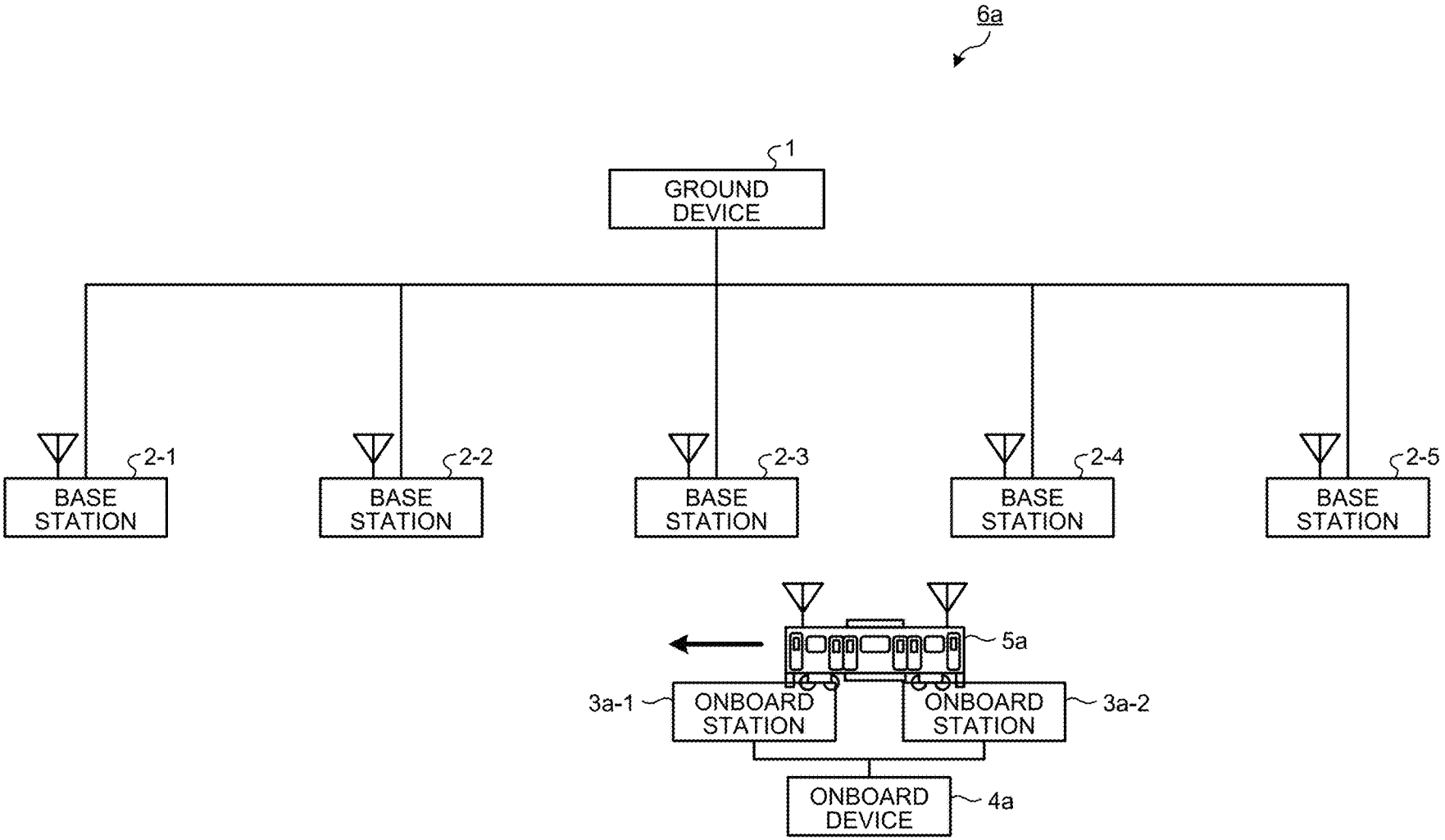
FIG. 11 is a diagram illustrating an example configuration of a train location measurement system according to a second embodiment.

FIG. 11 is a diagram illustrating an example configuration of a train location measurement system 6*a* according to the second embodiment. The train location measurement system 6*a* includes onboard stations 3*a*-1 and 3*a*-2 and an onboard device 4*a* in place of the onboard stations 3-1 and 3-2 and the onboard device 4 of the train location measurement system 6 illustrated in FIG. 1. Similarly to FIG. 1, FIG. 11 illustrates the onboard stations 3*a*-1 and 3*a*-2 and the onboard device 4*a* outside the train 5*a*, but in fact, the onboard stations 3*a*-1 to 3*a*-2 and the onboard device 4*a* are disposed inside the train 5*a*. In the description below, the onboard stations 3*a*-1 to 3*a*-2 may also be referred to as onboard station(s) 3*a* when no distinction is made.

Figure 12:
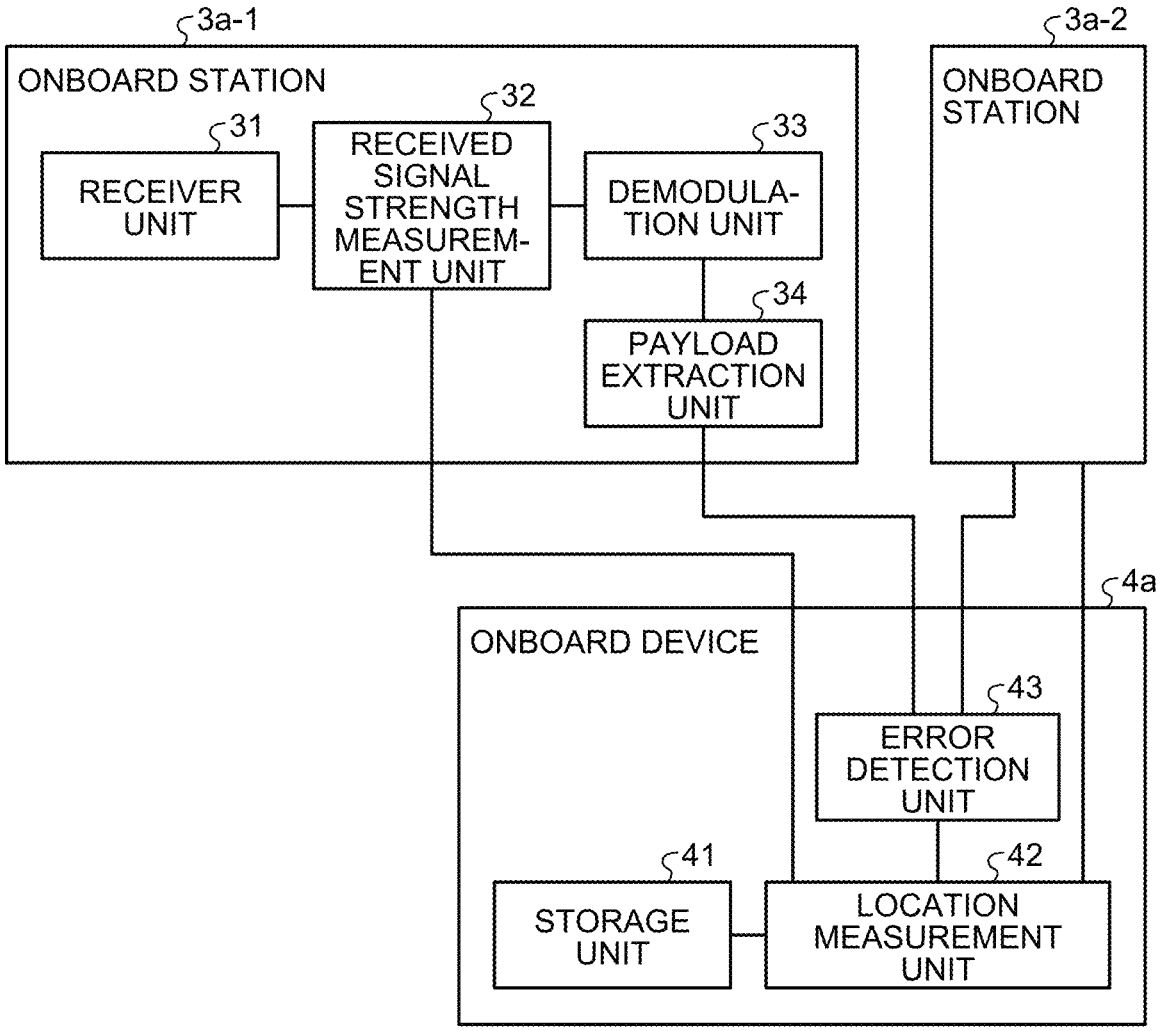
FIG. 12 is a block diagram illustrating an example configuration of an onboard station and an onboard device installed on a train according to the second embodiment.

FIG. 12 is a block diagram illustrating an example configuration of the onboard stations 3*a* and the onboard device 4*a* installed on the train 5*a* according to the second embodiment. Due to the similarity in configuration between the onboard stations 3*a*-1 and 3*a*-2, the onboard station 3*a*-1 will be used to describe the configuration of the onboard station 3*a*, and the onboard station 3*a*-2 is thus illustrated in outline. The onboard station 3*a*-1 has a configuration similar to the configuration of the onboard station 3-1 illustrated in FIG. 4 except that the error detection unit 35 is removed. The receiver unit 31, the received signal strength measurement unit 32, the demodulation unit 33, and the payload extraction unit 34 operate similarly to the first embodiment. The onboard device 4*a* additionally includes an error detection unit 43 in addition to the components of the onboard device 4 illustrated in FIG. 4. The error detection unit 43 operates similarly to the error detection unit 35 of the first embodiment. That is, in the second embodiment, the onboard device 4*a* performs the error detection, which is performed in the onboard stations 3 in the first embodiment. Note that, in regard to the error detection unit 43, error information generated using the location measuring data 83 obtained from the onboard station 3*a*-1 is referred to as first error information, and error information generated using the location measuring data 83 obtained from the onboard station 3*a*-2 is referred to as second error information.

The error detection unit 43 obtains the location measuring data 83 contained in the first signal from the onboard station 3*a*-1, and then generates, using this location measuring data 83, first error information indicating an error occurrence status upon reception of the first signal at the onboard station 3*a*-1. The error detection unit 43 also obtains the location measuring data 83 contained in the second signal from the onboard station 3*a*-2, and then generates, using this location measuring data 83, second error information indicating an error occurrence status upon reception of the second signal at the onboard station 3*a*-2. The location measurement unit 42 of the second embodiment obtains, from the error detection unit 43, the first error information and the second error information, which are obtained from the onboard stations 3-1 and 3-2 in the first embodiment. The location measurement unit 42 performs the other operations similarly to the first embodiment.

Figure 13:
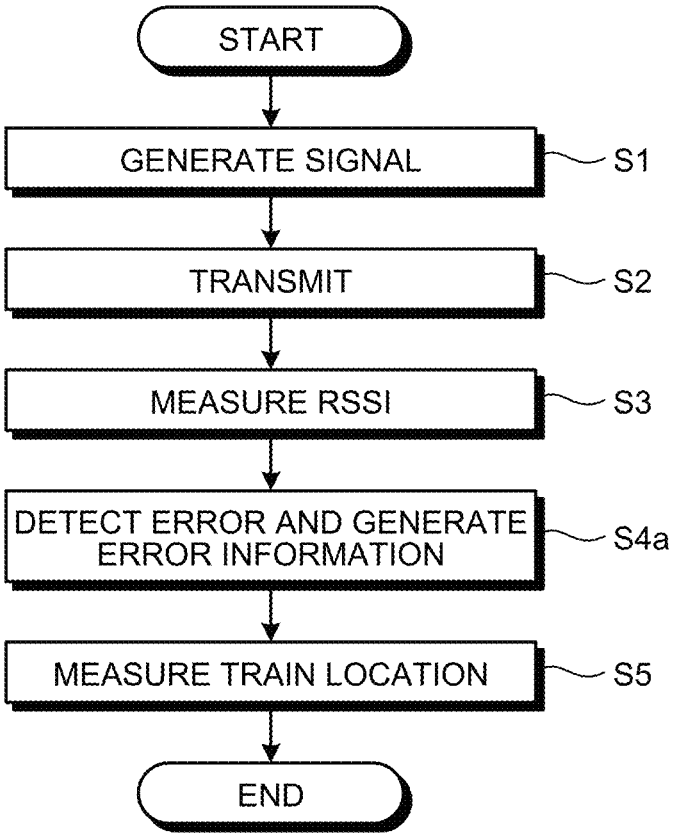
FIG. 13 is a flowchart illustrating an operation up to measurement of the location of the train by the onboard device in the train location measurement system according to the second embodiment.

FIG. 13 is a flowchart illustrating an operation up to measurement of the location of the train 5*a* by the onboard device 4*a* in the train location measurement system 6*a* according to the second embodiment. In contrast to the first embodiment in which the operation at step S4 is performed by the error detection unit 35 in each of the onboard stations 3-1 and 3-2, the operation at step S4*a* is performed by the error detection unit 43 of the onboard device 4*a* in the second embodiment. The other operations are similar to the corresponding operations of the first embodiment.

Note that, similarly to the first embodiment, the hardware configurations of the onboard stations 3*a* and of the onboard device 4*a* in the second embodiment are implemented in the configuration illustrated in FIG. 9 or 10.

As described above, error detection is performed by the onboard device 4*a* in the present embodiment. This operation can also provide an advantage similar to the advantage of the first embodiment.

The configurations described in the foregoing embodiments are merely examples of various aspects of the present invention. These configurations may be combined with a known other technology, and moreover, a part of such configurations may be omitted and/or modified without departing from the spirit of the present invention.

REFERENCE SIGNS LIST 1 ground device; 2, 2-1 to 2-5 base station; 3, 3-1, 3-2, 3*a*-1, 3*a*-2 onboard station; 4, 4*a* onboard device; 5, 5*a* train; 6, 6*a* train location measurement system; 11, 41 storage unit; 12 signal generation unit; 13 transmission control unit; 31 receiver unit; 32 received signal strength measurement unit; 33 demodulation unit; 34 payload extraction unit; 35, 43 error detection unit; 42 location measurement unit.

The invention claimed is:

1. A train location measurement system comprising:

a ground device installed on a ground to generate a signal that contains location measurement data for use in a train in measurement of a location of that train, and to output the signal to a plurality of base stations;

the plurality of base stations each installed on the ground to transmit the signal obtained from the ground device to the train;

a first onboard station installed on the train to measure a first received signal strength of a first signal, which is the signal received from a first base station located in a travel direction of the train, among the plurality of base stations, and to generate, using the location measuring data, first error information indicating an error occurrence status upon reception of the first signal;

a second onboard station installed on the train to measure a second received signal strength of a second signal, which is the signal received from a second base station located in a direction opposite the travel direction of the train, among the plurality of base stations, and to generate, using the location measuring data, second error information indicating an error occurrence status upon reception of the second signal; and an onboard device installed on the train to measure the location of the train based on the first received signal strength, on the first error information, on the second received signal strength, and on the second error information.

2. The train location measurement system according to claim 1, wherein the onboard device includes a storage storing base station location information indicating a location of each base station of the plurality of base stations, train length information indicating a length of the train, a received signal strength characteristic representing a relationship between a distance from each base station of the plurality of base stations and a received signal strength, and an error characteristic representing a relationship between a distance from each base station of the plurality of base stations and an error occurrence status indicated by error information, and processing circuitry to measure the location of the train based on the first received signal strength, on the first error information, on the second received signal strength, and on the second error information, using information stored in the storage.

3. The train location measurement system according to claim 2, wherein the location measuring data contains a plurality of pieces of data encoded by different coding rates, the error characteristic includes a relationship, for each of the coding rates, between a distance from the each base station and a bit error rate, and the processing circuitry extracts a candidate for the location of the train for each of the coding rates based on the first error information, on the second error information, and on the error characteristic for each of the coding rates, extracts a candidate for the location of the train based on the first received signal strength, on the second received signal strength, and on the received signal strength characteristic, and measures the location of the train based on the plurality of candidates extracted for the location of the train.

4. A train location measurement system comprising:

a ground device installed on a ground to generate a signal that contains location measurement data for use in a train in measurement of a location of that train, and to output the signal to a plurality of base stations;

the plurality of base stations each installed on the ground to transmit the signal obtained from the ground device to the train;

a first onboard station installed on the train to measure a first received signal strength of a first signal, which is the signal received from a first base station located in a travel direction of the train, among the plurality of base stations;

a second onboard station installed on the train to measure a second received signal strength of a second signal, which is the signal received from a second base station located in a direction opposite the travel direction of the train, among the plurality of base stations; and an onboard device installed on the train to generate, using the location measuring data contained in the first signal, first error information indicating an error occurrence status upon reception of the first signal, to generate, using the location measuring data contained in the second signal, second error information indicating an error occurrence status upon reception of the second signal, and to measure the location of the train based on the first received signal strength, on the first error information, on the second received signal strength, and on the second error information.

5. The train location measurement system according to claim 4, wherein the onboard device includes a storage storing base station location information indicating a location of each base station of the plurality of base stations, train length information indicating a length of the train, a received signal strength characteristic representing a relationship between a distance from each base station of the plurality of base stations and a received signal strength, and an error characteristic representing a relationship between a distance from each base station of the plurality of base stations and an error occurrence status indicated by error information, and processing circuitry to measure the location of the train based on the first received signal strength, on the first error information, on the second received signal strength, and on the second error information, using information stored in the storage.

6. The train location measurement system according to claim 5, wherein the location measuring data contains a plurality of pieces of data encoded by different coding rates, the error characteristic includes a relationship, for each of the coding rates, between a distance from the each base station and a bit error rate, and the processing circuitry extracts a candidate for the location of the train for each of the coding rates based on the first error information, on the second error information, and on the error characteristic for each of the coding rates, extracts a candidate for the location of the train based on the first received signal strength, on the second received signal strength, and on the received signal strength characteristic, and measures the location of the train based on the plurality of candidates extracted for the location of the train.

7. An onboard device in a situation in which a signal that stores location measurement data for use in train location measurement is transmitted from a ground device through a plurality of base stations, the onboard device comprising:

a storage storing base station location information indicating a location of each base station of the plurality of base stations, train length information indicating a length of a train, a received signal strength characteristic representing a relationship between a distance from each base station of the plurality of base stations and a received signal strength, and an error characteristic representing a relationship between a distance from each base station of the plurality of base stations and an error occurrence status indicated by error information; and processing circuitry to obtain, from a first onboard station, a first received signal strength measured on a first signal, which is the signal received from a first base station located in a travel direction of the train, among the plurality of base stations, and first error information indicating an error occurrence status detected using the location measuring data, to obtain, from a second onboard station, a second received signal strength measured on a second signal, which is the signal received from a second base station located in a direction opposite the travel direction of the train, among the plurality of base stations, and second error information indicating an error occurrence status detected using the location measuring data, and to measure a location of the train based on the first received signal strength, on the first error information, on the second received signal strength, and on the second error information, using information stored in the storage.

8. The onboard device according to claim 7, wherein the location measuring data contains a plurality of pieces of data encoded by different coding rates, the error characteristic includes a relationship, for each of the coding rates, between a distance from the each base station and a bit error rate, and the processing circuitry extracts a candidate for the location of the train for each of the coding rates based on the plurality of pieces of data encoded by different coding rates, and on the error characteristic for each of the coding rates, extracts a candidate for the location of the train based on the first received signal strength, on the second received signal strength, and on the received signal strength characteristic, and measures the location of the train based on the plurality of candidates extracted for the location of the train.

* * * * *